US008951149B1

(12) United States Patent
Gorman

(10) Patent No.: US 8,951,149 B1
(45) Date of Patent: Feb. 10, 2015

(54) ADJUSTABLE GOLF TEE SETTING DEVICE WITH INTEGRATED BALL MARKER AND DIVOT REPAIR TOOL

(71) Applicant: Michael G. Gorman, Lemont, IL (US)

(72) Inventor: Michael G. Gorman, Lemont, IL (US)

( * ) Notice: Subject to any disclaimer, the term of this patent is extended or adjusted under 35 U.S.C. 154(b) by 0 days.

(21) Appl. No.: 14/102,670

(22) Filed: Dec. 11, 2013

(51) Int. Cl.
*A63B 57/00* (2006.01)

(52) U.S. Cl.
CPC ..... *A63B 57/0037* (2013.01)
USPC ..... 473/386

(58) Field of Classification Search
USPC ..... 473/386, 407, 222
See application file for complete search history.

(56) References Cited

U.S. PATENT DOCUMENTS

| | | | | | |
|---|---|---|---|---|---|
| 1,852,956 | A * | 4/1932 | Czichos | 473/284 |
| 3,074,719 | A * | 1/1963 | McKee | 473/386 |
| 4,142,719 | A * | 3/1979 | Blood | 473/386 |
| 4,313,604 | A * | 2/1982 | Baxter | 473/386 |
| 4,660,837 | A * | 4/1987 | Bressie | 473/386 |
| 4,736,877 | A * | 4/1988 | Clark | 473/408 |
| 5,370,388 | A * | 12/1994 | Wehner | 473/386 |
| 5,643,113 | A * | 7/1997 | Rodgers | 473/386 |
| 6,949,033 | B1 * | 9/2005 | Mydland | 473/386 |
| 7,121,962 | B2 * | 10/2006 | Reeves | 473/407 |
| 7,223,184 | B2 * | 5/2007 | Suwito | 473/386 |
| 8,747,242 | B2 * | 6/2014 | Erario et al. | 473/199 |
| 2002/0027524 | A1 * | 3/2002 | Pippin | 473/407 |
| 2002/0082122 | A1 * | 6/2002 | Pippin et al. | 473/407 |
| 2002/0183138 | A1 * | 12/2002 | Malcolm | 473/386 |
| 2005/0049085 | A1 * | 3/2005 | Cumisky et al. | 473/386 |
| 2008/0135444 | A1 * | 6/2008 | Malcom | 473/406 |
| 2010/0309047 | A1 * | 12/2010 | Balardeta et al. | 342/357.57 |
| 2013/0150187 | A1 * | 6/2013 | Hanley | 473/386 |
| 2014/0038750 | A1 * | 2/2014 | Leech | 473/407 |
| 2014/0274474 | A1 * | 9/2014 | Schlamp | 473/386 |

* cited by examiner

*Primary Examiner* — Steven Wong
(74) *Attorney, Agent, or Firm* — Depeng Bi; The Law Offices of Konrad Sherinian, LLC

(57) ABSTRACT

A device for setting a consistent ball height on the golf tee for driving is disclosed. Additional features include an incorporated ball marker and putting green divot repair tool, each of which is held in place with a small magnet for easy access and use. The device comprises a cylindrical body made of hard material, such as plastic or wood, with an open lower end and a closed upper surface. The tee is inserted into the open end and rests against the concave head of an internal adjustment screw that the golfer has positioned to the desired ball height. The tee is then pushed into the ground to the meet the bottom of the device. The device is then removed and the ball placed on the tee.

2 Claims, 4 Drawing Sheets

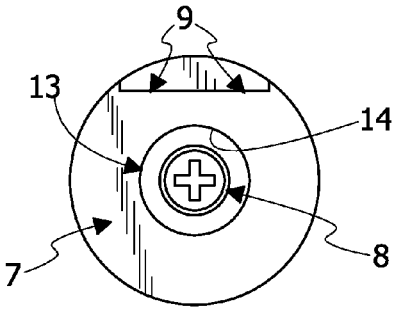
Fig. 3
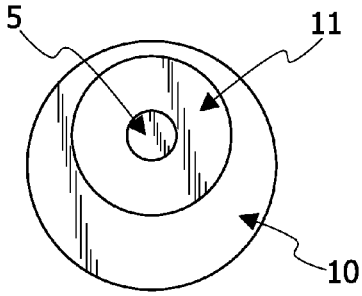
Fig. 4
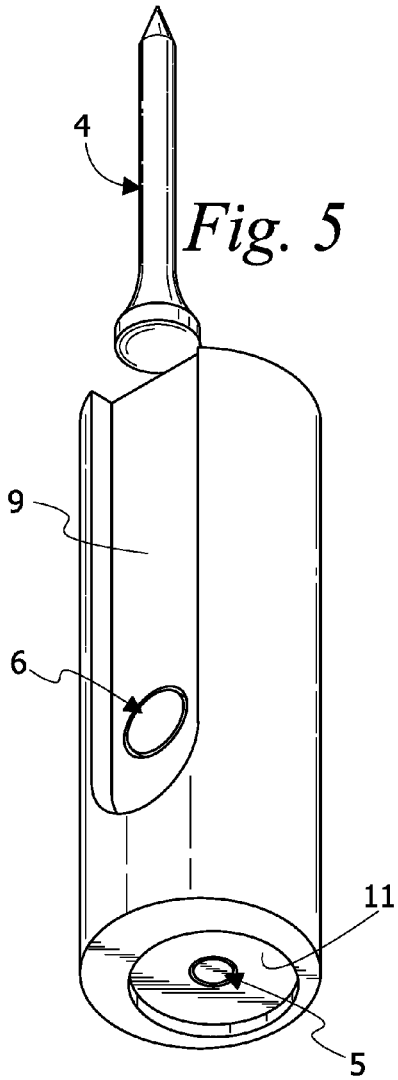
Fig. 5
Fig. 6
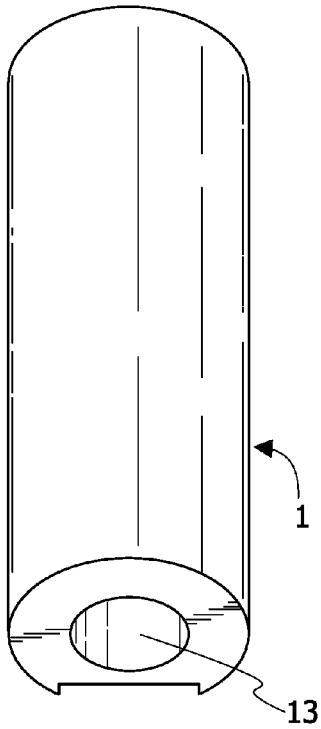

Fig. 7
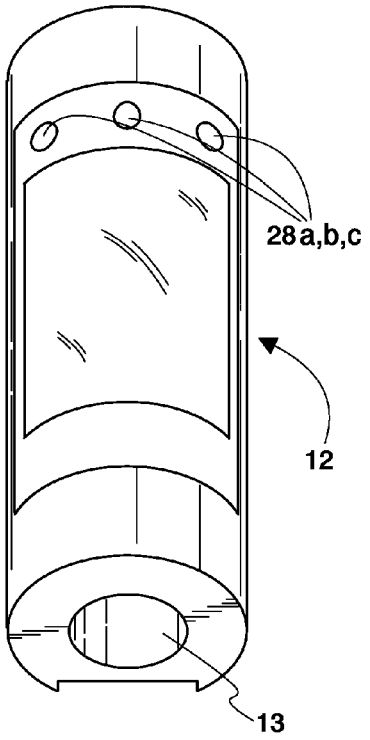
Fig. 8
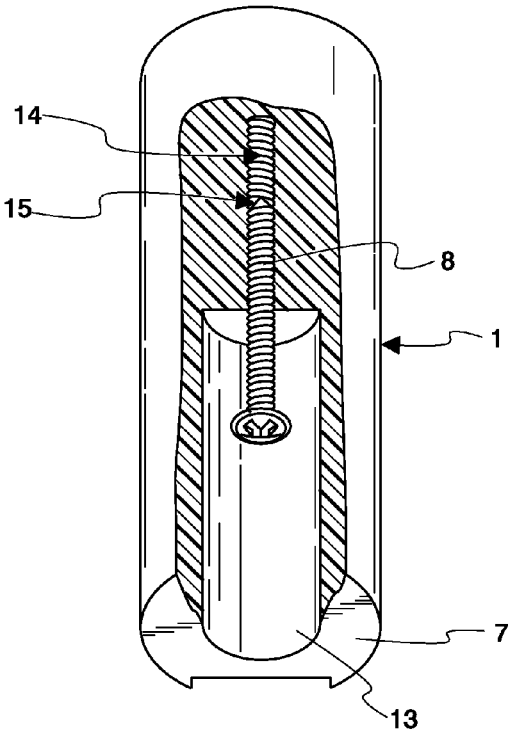
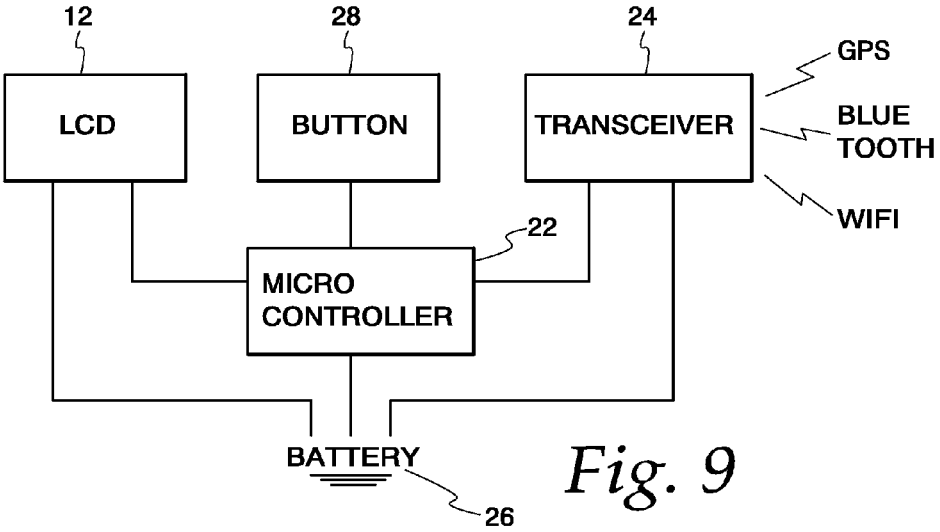
Fig. 9

ADJUSTABLE GOLF TEE SETTING DEVICE WITH INTEGRATED BALL MARKER AND DIVOT REPAIR TOOL

CROSS REFERENCE TO RELATED APPLICATIONS

None

FIELD OF THE DISCLOSURE

The present disclosure relates to a handheld device that allows a golfer to place a tee in the ground so as to support a golf tee at a desired height above the ground.

BACKGROUND

The importance of getting a good drive off the tee is well known to those who enjoy the game of golf. Studies have shown that an important variable in determining the quality of a drive is consistently setting the tee at a correct height for the golf club being used. Driver heads vary in their face size and the resulting ideal location of the sweet spot for maximum distance and accurate drives. Recommended ball heights mostly range from 1⅜ inches to 2 inches. The nonprofessional golfer experiences the problem of consistency due to tee grass length and variances in tee height from hole to hole caused by the usual method of placing the ball on the tee and plunging it into the ground to the depth that s/he thinks is about right.

As a result there have been many inventions developed to address this problem. Two popular solutions are the "step tee" and "brush tee" which both limit the penetration of the tee into the ground and provide consistent ball height control. These, however, break down and are somewhat costly when compared to standard wooden tees.

There are many patents in the field of inserting a golf tee for consistent height. Those that are adjustable are somewhat complex to manufacture and/or use. These include slotted configurations, use of springs, ball bearings, movable disks, and such. Prior art tee setting tools that are not adjustable necessitate that the golfer acquire a set of the tools to try out and select the one that best suits their need.

In addition, for a normal round of golf, a golfer will need to carry a number of other devices, such as a ball marker needed to mark her ball on the green and a divot repair tool, which is used by responsible golfers to maintain the green. When a golf ball lands on the green it often makes a dent or divot in the putting surface that must be repaired to avoid damage to the smooth surface. Therefore each golfer carries a tool to repair such divots caused during their play. No known prior art tee setting tools incorporate such tools

OBJECTS OF THE DISCLOSED SYSTEM, METHOD, AND APPARATUS

Accordingly, it is an object of this disclosure to provide an improved tee setting device.

Another object of this disclosure is to provide an easily adjustable tee setting device.

Another object of this disclosure is to provide an improved tee setting device that allows the use of inexpensive standard tees.

Another object of this disclosure is to provide an inexpensive to manufacture improved tee setting device.

Another object of this disclosure is to provide an improved tee setting device incorporating a ball marker.

Another object of this disclosure is to provide an improved tee setting device incorporating a divot repair tool.

Another object of this disclosure is to provide an improved tee setting device incorporating a display for showing distance to the green.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

A golf tee setting device is disclosed. The golf tee setting device is comprised of a substantially cylindrical housing having top and bottom surfaces. A cavity is formed in the bottom surface along a longitudinal axis of the golf tee setting device, the cavity being sized and shaped to receive and guide golf tees of various heights. A screw shaft is formed into an upper portion of the substantially cylindrical housing and an adjustable screw is disposed in the screw shaft to allow a user to lengthen or shorten the screw so that the aforementioned tee can be driven into the ground so that a ball set upon the tee sits at a desired height.

In an additional embodiment of the disclosed golf tee setting device, two recessed cavities are formed in the top and side of the substantially cylindrical housing. The cavity in the top is adapted to hold a ball marker, while the cavity in the side is adapted to hold a divot repair tool. The ball marker and divot repair tool can both be constructed of a magnetically susceptible metal and can be held in place by, for example, a pair of magnets disposed within the substantially cylindrical housing near the ball marker and divot repair tool respectively.

Finally, the golf tee setting device can be further improved by the integration of a display, an input device, a microcontroller, and a wireless transceiver. The wireless transceiver can receive information from, for example, a mobile computing device regarding the distance to the center and the front and back of the green. The microcontroller can process this information and display it on the display. In this embodiment, the user can provide input using the input device to vary the information that is displayed.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 3 is a bottom view of an improved tee setting device constructed in accordance with this disclosure;

FIG. 4 is a top view of an improved tee setting device constructed in accordance with this disclosure, and with the ball marker removed so that the ball marker holding mechanism is clearly visible;

FIG. 5 is a side view of an improved tee setting device constructed in accordance with this disclosure, and with the magnets used to hold the ball marker and divot repair tool clearly visible;

FIG. 6 is a side view of an improved tee setting device constructed in accordance with this disclosure, with the plain side visible;

FIG. 7 is a side view of an alternative embodiment of an improved tee setting device constructed in accordance with this disclosure, with a display for viewing the distance to the green;

FIG. 8 is an exploded side view of an improved tee setting device constructed in accordance with this disclosure; and FIG. 9 is a simplified schematic view of an electronic circuit for use with the improved tee setting device disclosed herein.

DETAILED DESCRIPTION

Figure 1:
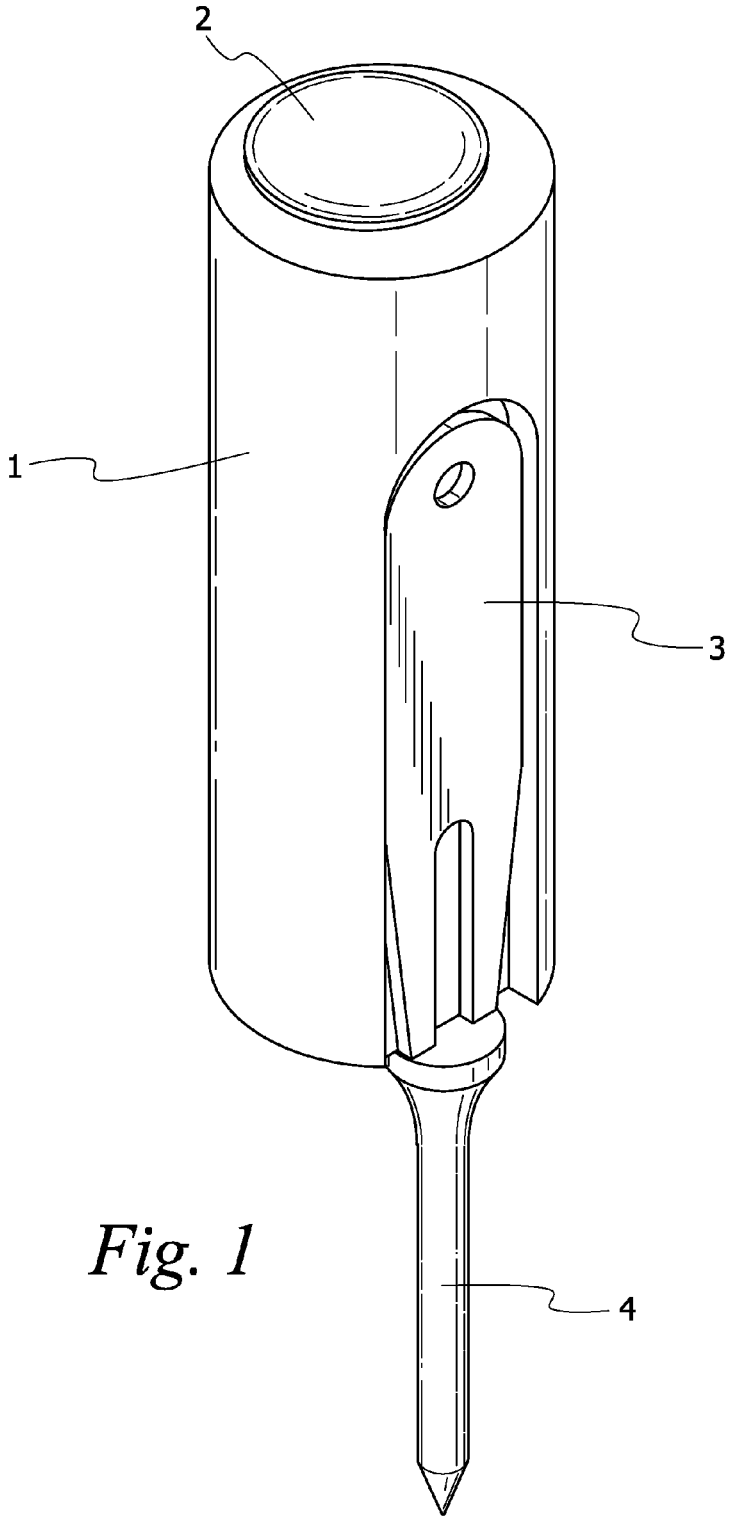
FIG. 1 is a perspective view of an improved tee setting device constructed in accordance with this disclosure.

Turning to the Figures and to FIG. 1 in particular, the disclosed tee setting device consists of a substantially cylindrical housing 1 made of a hard material, such as wood or plastic. Recessed into the top of the cylindrical housing 1 is a ball marker 2; recessed into the side of the cylindrical housing 1 is a divot repair tool 3. The bottom of the cylindrical housing 1 (not shown) is adapted to receive a tee 4, so that it can be used to drive the tee 4 into ground.

Figure 2:
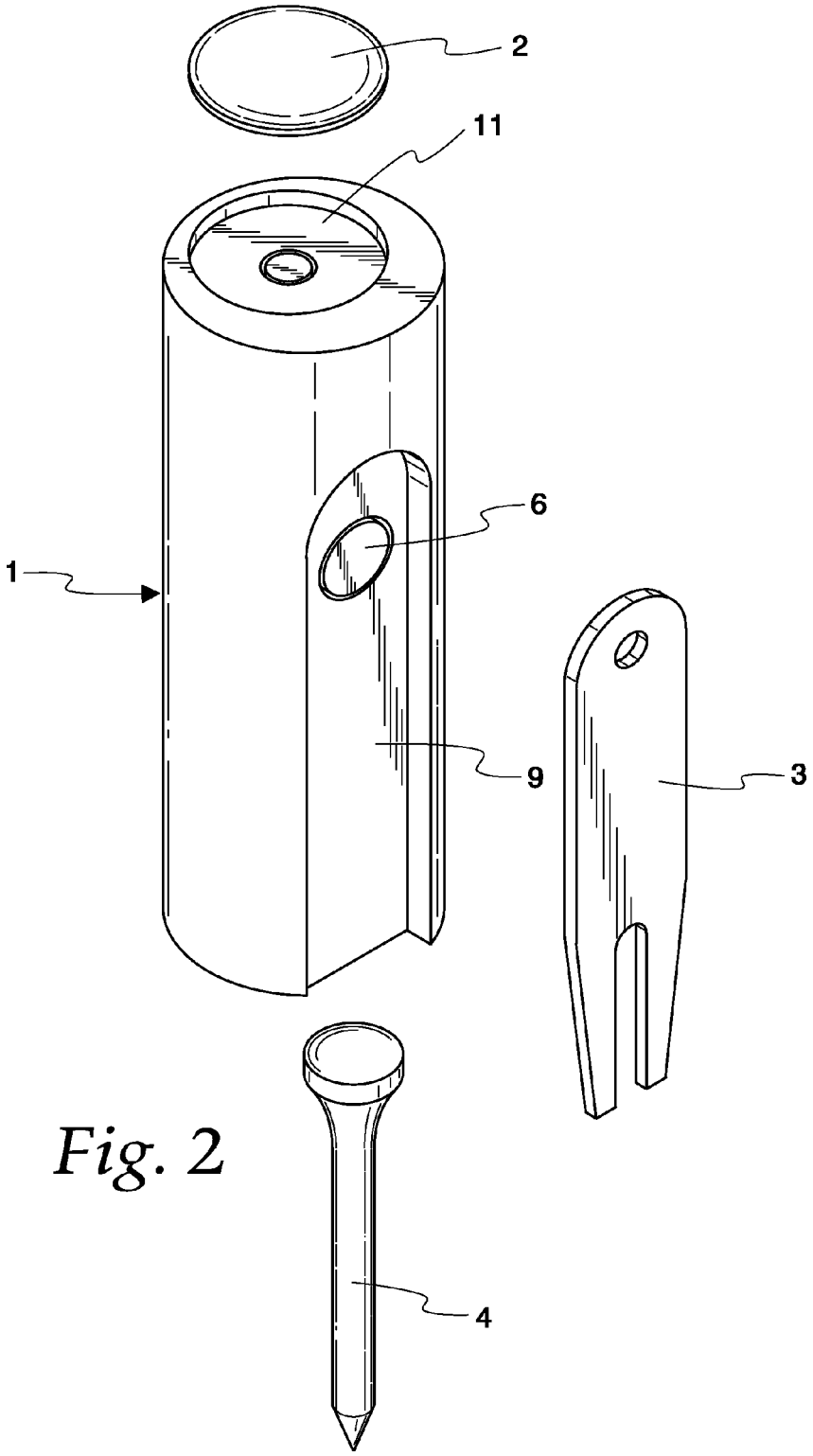
FIG. 2 is a frontal view of an improved tee setting device constructed in accordance with this disclosure and illustrating the ball marker and divot repair tool disassembled from the device.

Turning to FIGS. 2, 3, and 4 (as well as FIGS. 6 and 8) the cylindrical housing 1 incorporates a recessed area along one side 9 and on top 11 and two external metallic tools—ball marker 2 and divot repair tool 3—which are held in place in respective recessed areas assigned to them by small magnets 5 and 6. In a preferred embodiment, both the ball market 2 and the divot repair tool 3 are constructed of a magnetically susceptible metal. The regular wooden tee 4 is inserted into the hollowed out cavity 13 at the bottom of the housing up to the head of the adjustment screw 8 which is embedded in an upper surface 14 above the hollowed out cavity 13. The lower end of the cylindrical housing 1 also incorporates a solid lip 7 surrounding the hollowed out cavity 13.

Referring to magnets 5 and 6 shown in FIG. 5, these can be ¼ inch diameter by ⅛ inch depth magnets, which are commonly available. Magnets of other shapes and sizes could also be used. Magnet 6, for retention of the putting green divot repair tool 3, can be inserted and held into a 1/8 hole that is flush with the surface 9. In one embodiment, the magnet 6 is held in place by glue, although other methods known in the art will work equally well. For example, the magnet could be held in place by a system of tabs, or by forming a thin layer of plastic around the magnet, thereby holding it in place. The divot repair tool 3 can then be removed for use by simply sliding it down the surface 9. Magnet 5, for retention of the ball marker 2, need not be flush with the surface 11, but rather can be inserted and held in a 1/16 inch hole so that the ball marker rests above the surface 11 and can be easily removed from its recessed surface 11 by lightly pushing down on the outer edge of the marker tilting it above the opposite recessed edge and then pushing it sideways, thereby sliding it out of the recessed surface 11.

Referring to FIG. 8, this provides a cut-away view of the internal elements of the device. In the disclosed embodiment, a ½ inch channel 13 is cut from the bottom of the device to a depth of 2⅛ inches in order to allow the insertion of any standard tee 4. In the absence of the adjustable screw 8, the device would then insert any tee into the ground the full 2⅛ inches. However, with the fitting of the adjustable screw 8 tightly into a screw column 15 that is bored into the upper surface 14 above the cavity 13, this depth can be varied from 1⅜ inches to 2 inches to meet the exact tee-up distance required by the individual golfer and his/her particular driver (see also FIG. 3). The screw remains stable at whatever depth due to the relative tightness of its fit into upper surface 14. (It should be noted that longer depths could be accommodated by this device through the use of a longer body dimension).

FIG. 6 shows the smooth side of the cylindrical housing 1. Two uses for this surface are envisioned in this invention. One is to provide an area for advertising or personalized engraving (not shown). The other is to incorporate an LCD screen 12 into the body, along with its respective control buttons 28*a,b,c* as shown on FIG. 7. The primary purpose for this LCD 12 would be to indicate to the golfer the distances to the green's front, middle, and back from the golfer's position. The technology to do this is already in the marketplace via smart phone applications and the like and access could be negotiated via a wireless networking technology, such as, for example, Bluetooth or 802.11, and displayed on the device's LCD readout 12.

A simple schematic is provided in FIG. 9 that illustrates the operation of the disclosed LCD 12. The LCD 12 is coupled to a microcontroller 22, which receives inputs from an input device 28, such as a sequence of buttons or a touchscreen. The microcontroller 22 is also coupled to a wireless transceiver 24, such as a Bluetooth transceiver or a 802.11 transceiver, that is adapted to receive information from a smart phone (not shown) running an application that monitors the distance to the hole, as well as the back and front of the green. Using the input device 28 the microcontroller 22 determines what received information is displayed on the LCD 12.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. For example, while various specific dimensions were disclosed to better enable a person of skill in the art to easily reproduce the disclosed device without undue experimentation, different dimensions could be used and still fall within the coverage of the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A golf tee setting device comprising:

i) a substantially cylindrical housing having a bottom surface;

ii) a cavity formed into the bottom surface of the substantially cylindrical housing, the cavity being formed on a longitudinal access of the substantially cylindrical housing and being adapted to receive a tee, the cavity extending along a portion of the full longitudinal length of the substantially cylindrical housing;

iii) a screw shaft formed into an upper portion of the substantially cylindrical housing;

iv) an adjustable screw disposed in the screw shaft, the adjustable screw adapted to be operated through the cavity from the bottom surface, the adjustable screw being adapted to lengthen or shorten so that the tee can be driven into the ground so that a ball placed on the tee sits at a desired height;

v) a microcontroller disposed within said substantially cylindrical housing;

vi) a display disposed on a side of the substantially cylindrical housing and coupled to the microcontroller;

vii) an input device disposed on the side of the substantially cylindrical housing and coupled to the microcontroller;

viii) a wireless transceiver coupled to the microcontroller wherein the wireless transceiver is adapted to receive information from a mobile computing device, the information including the distance to a hole; and iv) wherein the microcontroller is adapted to process input from the input device and display the information received from the wireless transceiver on the display.

2. The golf tee setting device of claim 1 wherein the information further includes a distance to the front of a green, a distance to a center of the green, and a distance to a back of the green.

* * * * *